United States Patent [19]

Fables et al.

[11] Patent Number: 4,927,402

[45] Date of Patent: May 22, 1990

[54] RECONFIGURABLE LOOP APPARATUS

[76] Inventors: Wylci Fables; Jore Park, both of 4040 Galt Ocean Dr., Apartment 918, Fort Lauderdale, Fla. 33308

[21] Appl. No.: 383,244

[22] Filed: Jul. 19, 1989

Related U.S. Application Data

[63] Continuation of Ser. No. 144,947, Jan. 19, 1988, abandoned.

[51] Int. Cl.[5] ..... A63H 33/00

[52] U.S. Cl. ..... 446/487; 446/119; 446/490; 272/25

[58] Field of Search ..... 446/487, 236, 491, 119, 446/126, 486, 490, 15, 450; 273/424, 425; 272/21, 25

[56] References Cited

U.S. PATENT DOCUMENTS

| | | | |
|---|---|---|---|
| 2,765,580 | 10/1956 | Herrschaft | 446/119 |
| 4,274,222 | 6/1981 | Zahn et al. | 446/126 |
| 4,380,885 | 4/1983 | Komagata | 446/236 |

FOREIGN PATENT DOCUMENTS

| | | | |
|---|---|---|---|
| 344665 | 3/1960 | Switzerland | 446/119 |

*Primary Examiner*—Mickey Yu

*Attorney, Agent, or Firm*—Robin, Blecker, Daley & Driscoll

[57] ABSTRACT

Apparatus having at least three members joined by couplings to form a closed loop, each coupling being twistable and bendable such as to allow bending through an angle of substantially 360° in substantially all directions, whereby the loop can be made to take on a variety of configurations.

12 Claims, 2 Drawing Sheets

RECONFIGURABLE LOOP APPARATUS

This application is a continuation of application Ser. No. 144,947, filed Jan. 19, 1988, now abandoned.

BACKGROUND OF THE INVENTION

This invention relates to elements formed into loop structures and, in particular, to elements formed into loop structures which are reconfigurable.

In the art of games and novelty toys, a number of reconfigurable loop structures have been proposed for the amusement of a user. U.S. Pat. No. 1,853,436 discloses a puzzle type loop structure which comprises a number of interconnected flat strips. These strips are joined at their ends by pins which allow the strips to rotate through angles of 360° in a single direction. An improved version of the latter puzzle is disclosed in U.S. Pat. No. 3,977,683 wherein, the strips are made flexible to allow for deformation arcurately along the length and thickness of the strips.

Another somewhat different type of reconfigurable loop structure is disclosed in U.S. Pat. No. 4,232,473. In this structure the reconfigurable loop comprises interconnected tubular elements. These elements are in the form of L-shaped bends and T-shaped sections which are interconnected so that adjacent members are axially rotatable relative to one another. In one case, this axial rotation is achieved by disposing an elastic cord internally through all the sections to also form a closed loop. In another embodiment, the ends of the sections are configured so as to interlock in a manner which permits the desired axial rotation. Thus by appropriate axial rotation of these sections, the device of the '473 patent allows the user to form a variety of shapes for the loop.

While the above prior art reconfigurable loop structures are useable for their intended purposes, their construction limits the types of configurations and effects which can be realized with the loops. Thus, for example, the loops are not readily adaptable for other activities such as dance where a free forming reconfigurable loop could be used in creating a variety dance effects.

It is therefore a primary object of the present invention to provide a reconfigurable loop structure having a construction which allows for greater variation in configuration.

It is a further object of the present invention to provide a reconfigurable loop structure having a construction which allows for greater applications and uses for the loop.

SUMMARY OF THE INVENTION

In accordance with the principles of the present invention, the above and other objectives are realized in an apparatus comprising at least three elongated members which are interconnected by couplings to form a loop structure. Each coupling joins the ends of two adjacent members and is twistable and bendable such that the coupling can be bent through an angle of substantially 360° in substantially all directions. Due to the aforesaid characteristics of the couplings, the resultant loop structure is able to have significant variation in configuration and effect.

In the embodiment of the invention to be disclosed hereinafter, the couplings are tubular in form and receive the respective ends of the members which they connect. In this embodiment, the tubular couplings comprise a rubber-like material and the members are thin rods which are four in number.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
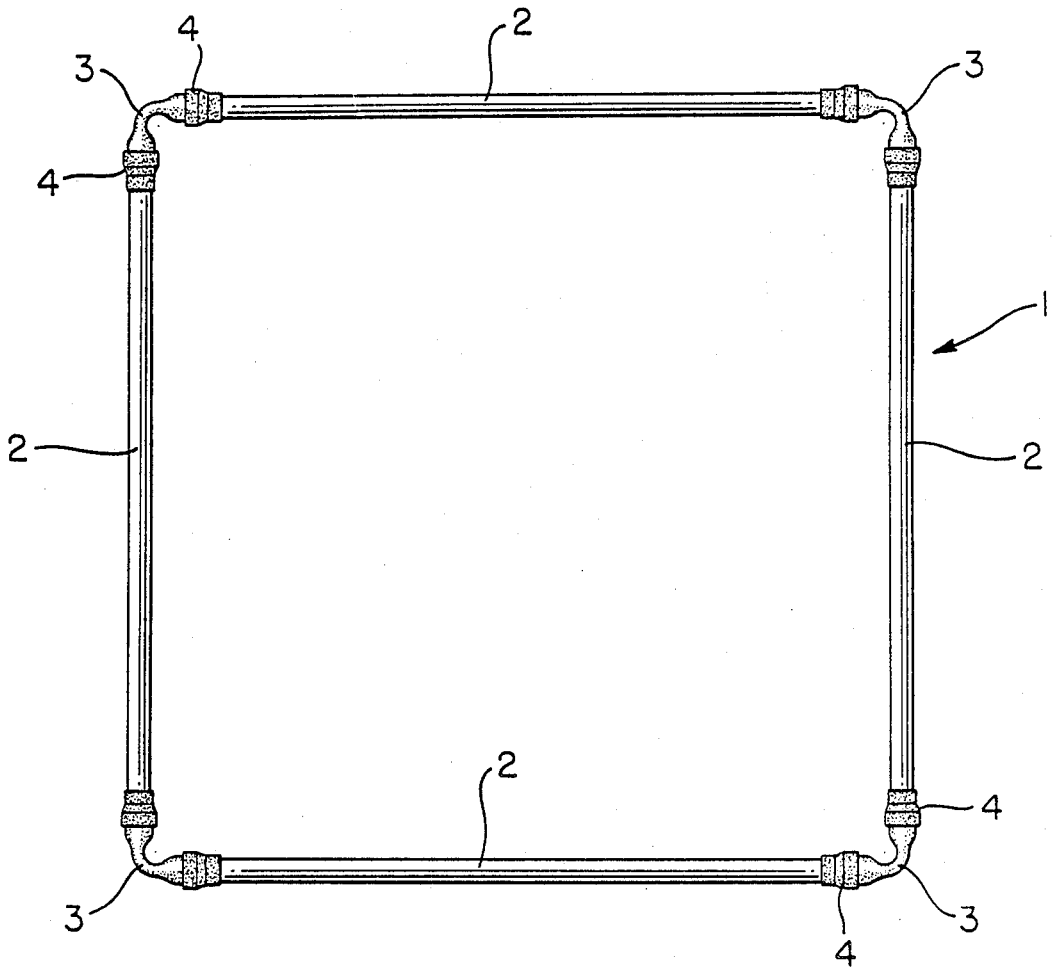
FIG. 1 shows an apparatus in accordance with the principles of the present invention.

In FIG. 1, apparatus 1 in accordance with the principles of the present invention is illustrated. The apparatus comprises four members, show as slender or thin rods 2, which are interconnected by couplings 3.

In accord with the invention, each of the couplings 3 is formed so as to be twistable and bendable such as to allow bending through an angle of substantially 360° in substantially all directions. In the particular case of FIG. 1, each coupling is a tubular piece of rubber-like material, the characteristics of the rubber being such that the aforesaid bending characteristics are achievable. A useable rubber-like tubing is latex- rubber tubing having an inner diameter of 5/16 inch.

In FIG. 1, each tubular rubber-like coupling 3 connects the ends of two adjacent rods 2. As shown in greater detail in FIG. 2, the respective ends *2a, 2b* of adjacent rods 2 are inserted into the opposite tube ends *3a, 3b* of a coupling 3. A collapsed central portion *3c* of the tube 3 results and this section undergoes the desired twisting and bending during reconfiguration of the apparatus 1 into its various shapes.

While the couplings 3 are illustrated herein as comprising rubber-like tubing, the invention is intended to extend to other couplings which exhibit the desired twisting and bending characteristics. Thus, for example couplings comprised of soft tempered aluminum might also be used.

Figure 2:
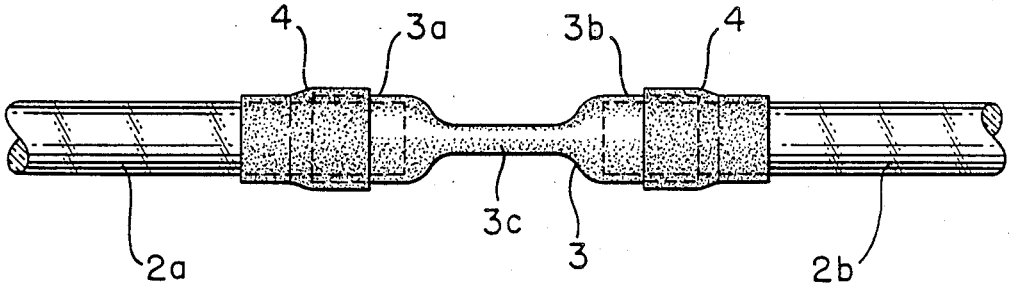
FIG. 2 shows in enlarged form a coupling used with the apparatus of FIG. 1.

As shown in FIG. 2, the ends *3a, 3b* of the couplings 3 are prevented from separating from the rods 2 by a suitable securing or fastening means. In the present illustrative case, tape 4 is used to bridge the junction between each end of the tubular coupling 3 and respective rod end and provides the necessary fastening between tube and rod.

Figure 3:
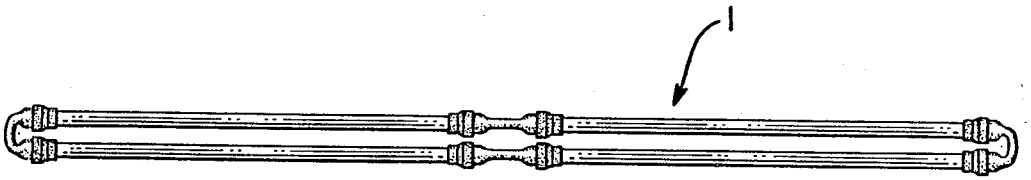
FIGS. 3 and 4 show the apparatus of FIG. 1 formed into different configurations.
Figure 4:
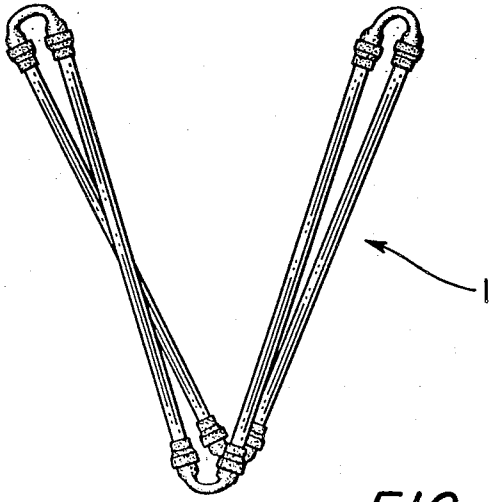

The rods 2 can be made from a variety of materials. One material might be ordinary Plexiglas of diameter of about ½ inch FIGS. 3 and 4 show two configurations which can be realized with the apparatus 1. In FIG. 3, the top and right hand rods shown in FIG. 1 have been brought to the left hand rod and bottom rod respectively so that the loop is collapsed. In this configuration, pairs of straight rods lie adjacent one another and form a straight line. In FIG. 4, the rods on the right and rods on the left in the collapsed loop of FIG. 3 are bent upward so that a V-configuration is formed. As can be appreciated, by further movement of the rods 2 in conjunction with the couplings 3 other configurations for the apparatus 1 can be realized.

The apparatus 1 has application as a playing apparatus for children who can enjoy the apparatus by forming in into its various configurations. It also may be used in dance productions to be held by a dancer who can move with the apparatus during the dance to achieve various free form and free flowing effects.

The size of the apparatus is determined by the lengths of the rods 2 and can be as desired depending upon the particular application. For dance productions, the size may be made sufficiently large so that a dancer may move through the loop in the performance of the dance.

In all cases, it is understood that the above-identified arrangements are merely illustrative of the many possible specific embodiments which represent applications of the present invention. Numerous and varied other arrangements can readily be devised in accordance with the principles of the invention without departing from the spirit and scope of the invention.

What is claimed is:

1. Apparatus comprising:

first, second, third and fourth elongated members, each member having first and second ends;

first, second, third and fourth couplings, said first coupling joining the first end of said first member to the first end of said second member, said second coupling joining the second end of said second member to the first end of said third member, said third coupling joining the second end of said third member to the first end of said fourth member, said fourth coupling joining the second end of said fourth member to the second end of said first member, whereby said couplings join the ends of the members together to form a closed loop, each coupling being twistable and bendable such that by bending of the coupling each member joined by the coupling can be moved through an angle of substantially 360° in substantially all directions relative to the other member joined by the coupling;

whereby the closed loop of joined elongated members can be reconfigured into a variety of shapes.

2. Apparatus in accordance with claim 1 wherein:

each coupling comprises a tubular member, the ends of the members joined by the coupling being inserted into the ends of the tubular member.

3. Apparatus in accordance with claim 2 wherein:

one or more of the tubular members comprises a rubber-like material.

4. Apparatus in accordance with claim 3 wherein:

said rubber-like material is latex rubber.

5. Apparatus in accordance with claim 3 wherein:

each member is a thin rod.

6. Apparatus in accordance with claim 5 wherein:

each rod comprises Plexiglas.

7. Apparatus in accordance with claim 2 wherein:

one or more of the tubular members comprise soft tempered aluminum.

8. Apparatus in accordance with claim 7 wherein:

each elongated member is thin rod.

9. Apparatus in accordance with claim 8 wherein:

each rod comprises Plexiglas.

10. Apparatus in accordance with claim 2 further comprising:

means for securing the end of each elongated member to the respective end of the tubular member into which the end of such elongated member is inserted.

11. Apparatus in accordance with claim 1 wherein:

each elongated member is a thin rod.

12. Apparatus in accordance with claim 11 wherein:

each rod comprises Plexiglas.

* * * * *